US007817944B2

(12) United States Patent
Li

(10) Patent No.: US 7,817,944 B2
(45) Date of Patent: Oct. 19, 2010

(54) POWDER-DELIVERING DEVICE FOR TONER CARTRIDGE

(75) Inventor: Kuan-Tung Li, Taichung County (TW)

(73) Assignee: General Plastic Industrial Co., Ltd., Taichung County (TW)

( * ) Notice: Subject to any disclaimer, the term of this patent is extended or adjusted under 35 U.S.C. 154(b) by 282 days.

(21) Appl. No.: 11/938,900

(22) Filed: Nov. 13, 2007

(65) Prior Publication Data

US 2009/0097885 A1 Apr. 16, 2009

(51) Int. Cl.
*G03G 15/08* (2006.01)

(52) U.S. Cl. ..... 399/262; 399/258

(58) Field of Classification Search ..... 359/263, 359/262, 258; 220/702, 695; 399/263, 262, 399/258

See application file for complete search history.

(56) References Cited

U.S. PATENT DOCUMENTS 6,038,422 A * 3/2000 Loewel ..... 399/262
6,104,902 A * 8/2000 Meyer et al. ..... 399/262
6,137,978 A 10/2000 Tsuchiya et al.

* cited by examiner

*Primary Examiner*—Constantine Hannaher
(74) *Attorney, Agent, or Firm*—Browdy and Neimark, PLLC

(57) ABSTRACT

A powder-delivering device includes a tapered shell received in a toner cartridge near an outlet of the toner cartridge. The tapered shell has a transection area becoming smaller gradually toward the outlet of the toner cartridge. The tapered shell has an outer surface having at least one projection or at least one recess. The projection of the tapered shell has a spiral or linear shape. The projection has an end, which is remote from the outlet of the toner cartridge, stopped against an inner wall of the toner cartridge. Thus, the powder-delivering device of the invention has simple structure and low product costs.

5 Claims, 5 Drawing Sheets

POWDER-DELIVERING DEVICE FOR TONER CARTRIDGE

BACKGROUND OF THE INVENTION

1. Field of the Invention

The present invention relates generally to a toner cartridge, and more specifically to a powder-delivering device for a toner cartridge, which has simple structure and can transport toner effectively.

2. Description of the Related Art

A conventional toner cartridge includes a barrel horizontally installed in an electric image forming apparatus and mounted with a spiral rib, an outlet formed on one end of the barrel and a powder-delivering device received in the barrel. In order to discharge toner out of the barrel through the outlet, the toner can be moved toward the outlet by the spiral rib due to the rotation of the barrel. The toner located at a bottom of the barrel can be moved by the powder-delivering device to the outlet near the axis of the barrel.

U.S. Pat. No. 6,137,978 discloses a powder-delivering device, as shown in FIGS. 4, 7 and 8 of the aforesaid patent, comprising two scraping members for moving the toner to an outlet through two conveying slopes. However, the powder-delivering device has complicated structure and high production costs.

SUMMARY OF THE INVENTION

The present invention has been accomplished in view of the above-noted circumstances. It is one objective of the present invention to provide a powder-delivering device for a toner cartridge, which has simple structure and low production costs.

It is another objective of the present invention to provide a powder-delivering device for a toner cartridge, which can transport the toner effectively.

To achieve these objectives of the present invention, the powder-delivering device comprises a tapered shell received in a toner cartridge near an outlet of the toner cartridge. The tapered shell has a transection area becoming smaller gradually toward the outlet, and an outer surface has at least one projection or at least one recess.

The projection of the tapered shell has a spiral shape or a linear shape and the projection of the tapered has an end, which is remote from the outlet, stopped against an inner wall of the toner cartridge. As a result, when the toner cartridge is rotated, the powder-delivering device can move the toner to the outlet.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
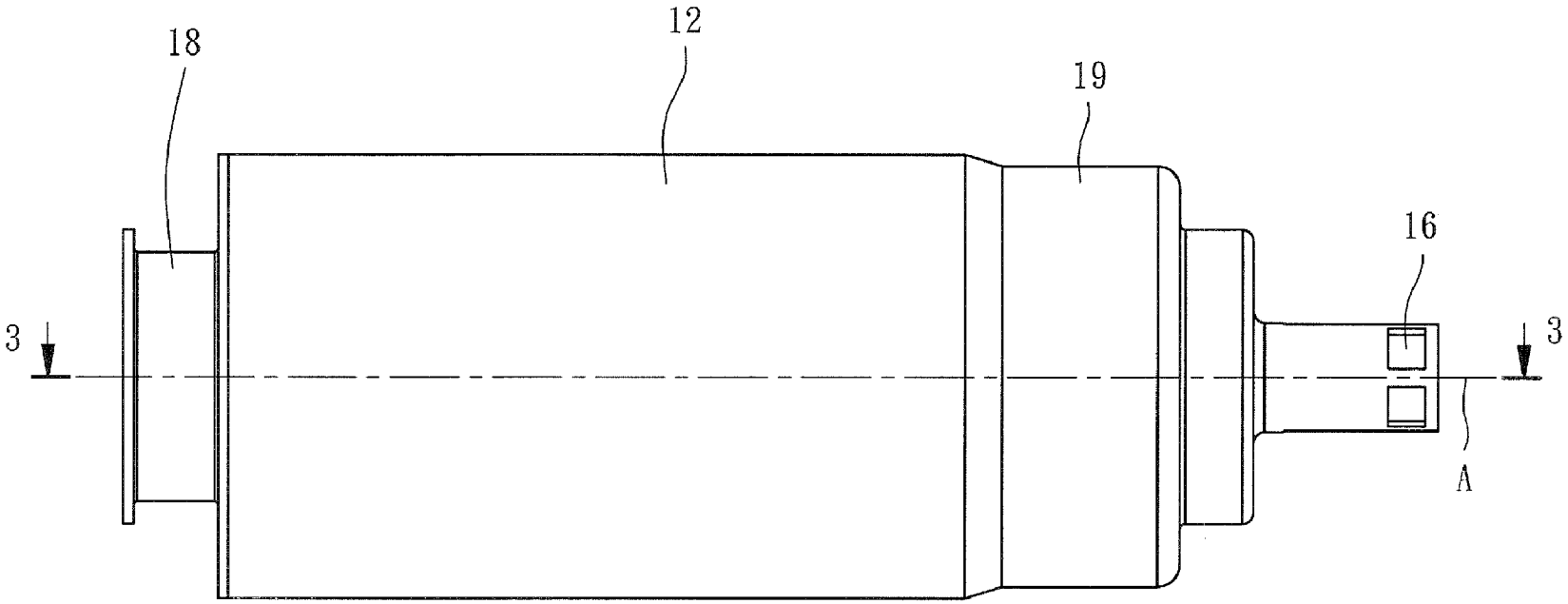
FIG. 1 is a front view of the toner cartridge according to a first embodiment of the present invention.
Figure 2:
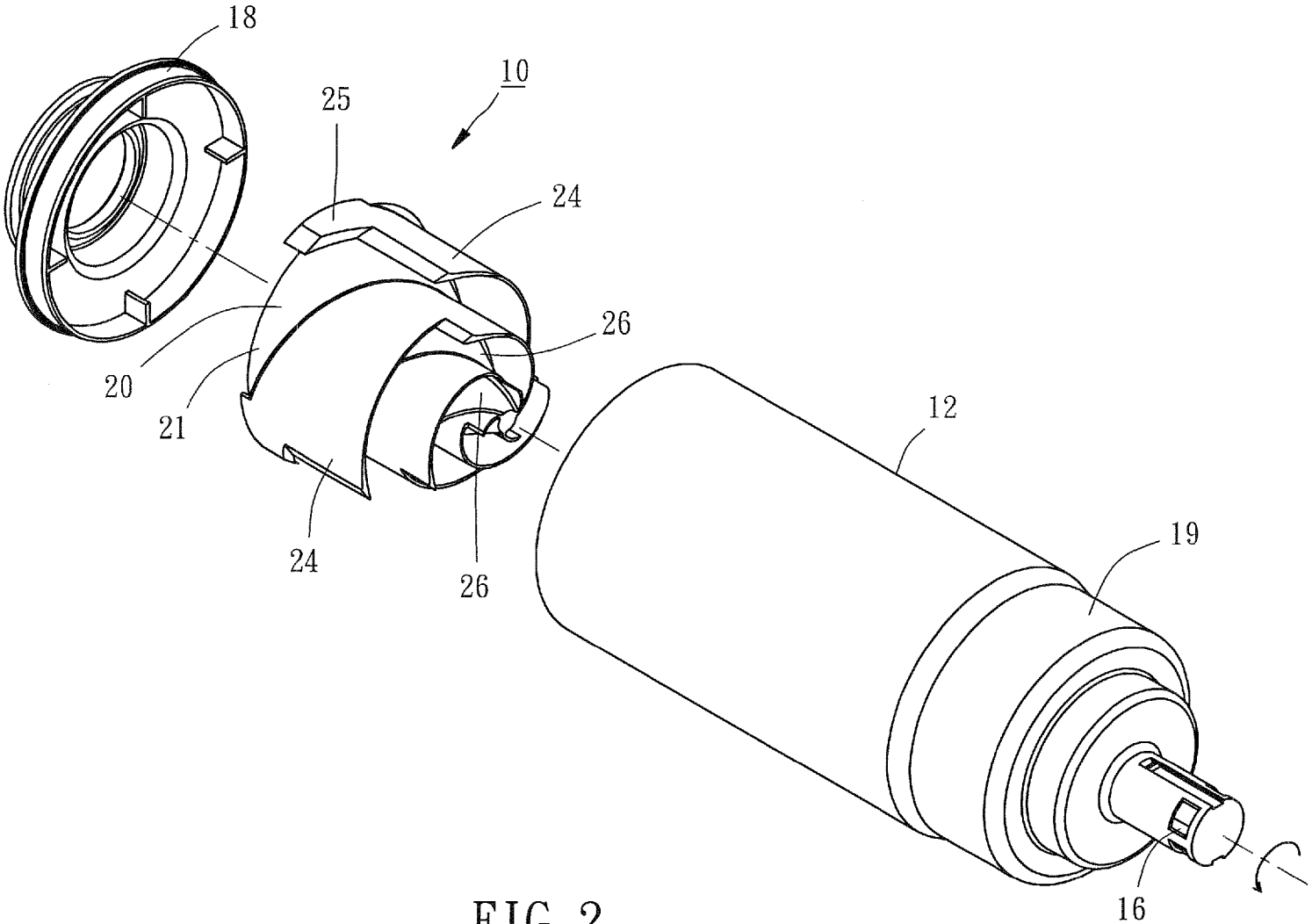
FIG. 2 is an exploded view of the toner cartridge according to the first embodiment of the present invention.

Referring to FIGS. 1 to 2, a toner cartridge 12 in accordance with the first embodiment of the present invention comprises an accommodation chamber 14 for accommodation of toner (not shown), an outlet 16 on a right end thereof, and a lid 18 covered on a left end thereof for closing the accommodation chamber 14. The toner cartridge 12 has a stepped inner wall 19 adjacent to the outlet 16 and extends along a longitudinal direction A.

Figure 3:
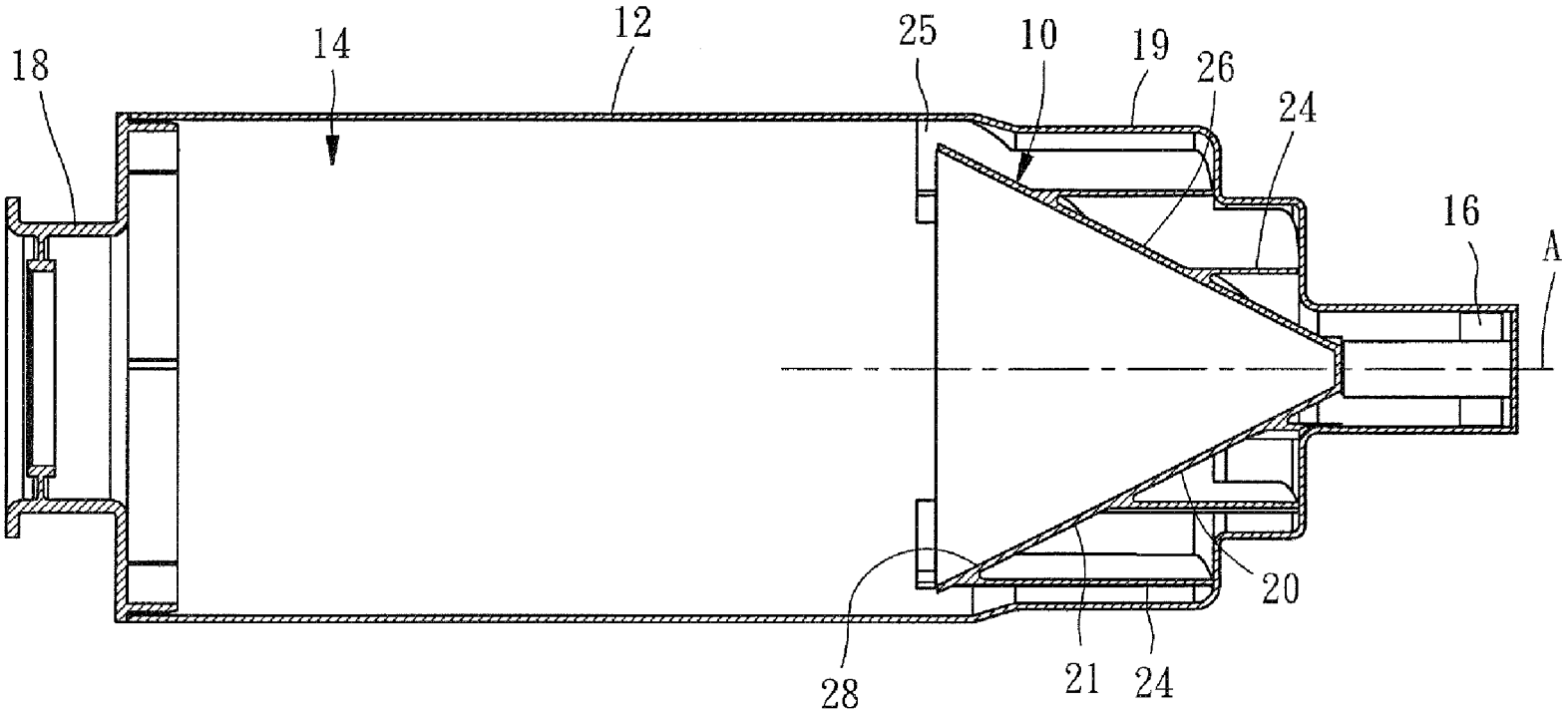
FIG. 3 is a sectional view taken along line 3-3 of FIG. 1.
Figure 4:
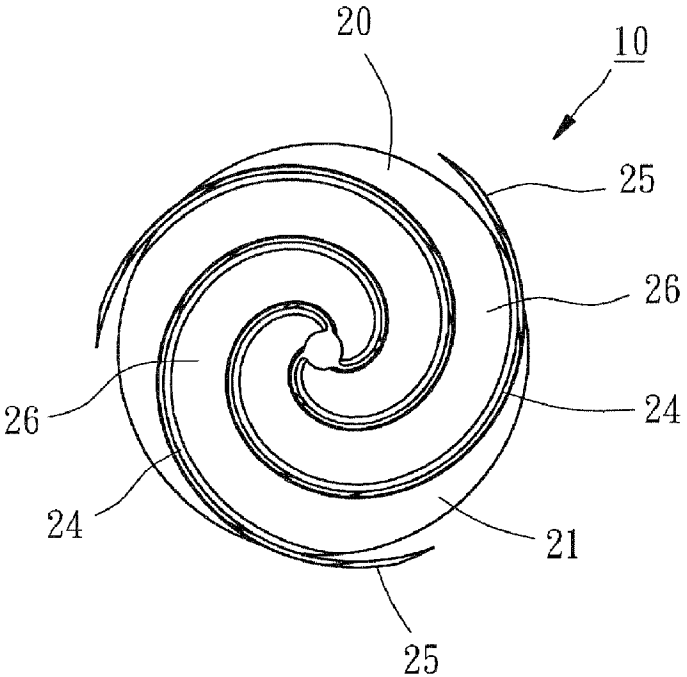
FIG. 4 is an end view of the powder-delivering device according to the first embodiment of the present invention.

Referring to FIGS. 2 to 4, a powder-delivering device 10 in accordance with the first embodiment of the present invention is received in the accommodation chamber 14 of the toner cartridge 12 near the outlet 16, including a tapered shell 20 having a transection area becoming smaller gradually toward the outlet 16, three spiral projections 24 extending along the longitudinal direction A of the toner cartridge 12 on an outer surface 21 thereof and three recesses 26 on the outer surface 21 thereof. The aforesaid transection area is the area surrounded by the outer periphery of the tapered shell 20. The projections 24 and the recesses 26 are arranged in a stagger manner. Ends of the projections 24, which are adjacent to the outlet 16, have a stepped shape to match with the inner wall 19 of the toner cartridge 12 and the other ends of the projections 24, which are remote from the outlet 16, are respectively provided with a scraper 25 stopped against the inner wall 19 of the toner cartridge 12. An inner surface 28 of the tapered shell 20 has a cone shape.

When the toner cartridge 12 is installed in an electric image forming apparatus (not shown), the longitudinal direction A of the toner cartridge 12 is horizontal and the toner is located at a bottom of the toner cartridge 12 due to gravity. When the toner cartridge 12 is rotated in a direction denoted by the arrow in FIG. 2, the powder-delivering device 10 is rotated together with the toner cartridge 12, and then the toner is forced by the scraper 25 to move to the recesses 26, and then the toner is moved to the outlet 16 of the toner cartridge 12 along the spiral recesses 26.

Because the powder-delivering device 10 of the present invention is injection-molded from plastics, the powder-delivering device 10 has simple structure and low product costs. Further, because the projections 24 of the powder-delivering device 10 is stopped against the inner wall 19 of the toner cartridge 12, a nearly sealed channel is formed among the tapered shell 20, the projections 24 and the inner wall 19 of the toner cartridge 12 for effectively transporting the toner led by the scraper 25.

Figure 5:
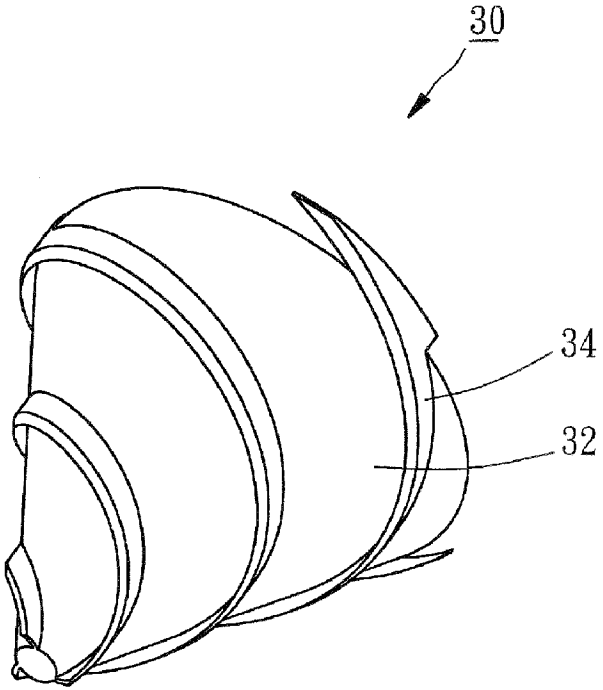
FIG. 5 is a perspective view of the powder-delivering device according to a second embodiment of the present invention.

The powder-delivering device can be made with various kinds of design on the basis of the spirit of the present invention. FIG. 5 shows a powder-delivering device 30 in accordance with the second embodiment of the present invention. The projections 34 of the tapered shell 32 are not stopped against the inner wall of the toner cartridge. On the contrary, the projections 34 extend a little distance from the tapered shell 32 so as to have more simple structure to achieve the objectives of the present invention.

Figure 6:
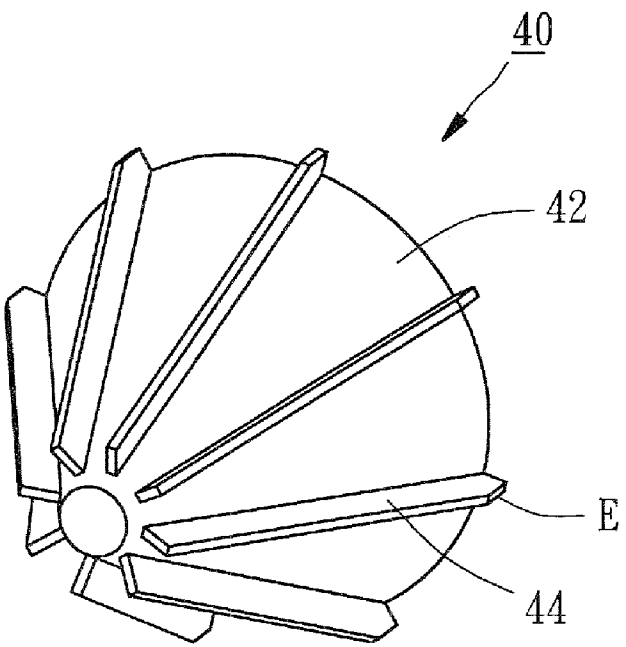
FIG. 6 is a perspective view of the powder-delivering device according to a third embodiment of the present invention.

FIG. 6 shows a powder-delivering device 40 in accordance with the third embodiment of the present invention comprising a tapered shell 42 and eight projections 44 extending from the tapered shell 42. Each projection 44 has a linear shape and an end E, which is remote from the outlet of the toner cartridge, stopped against the inner wall of the toner cartridge to replace the scraper of the above-mentioned embodiments such that the powder-delivering device 40 has the same function of transporting the toner.

Figure 7:
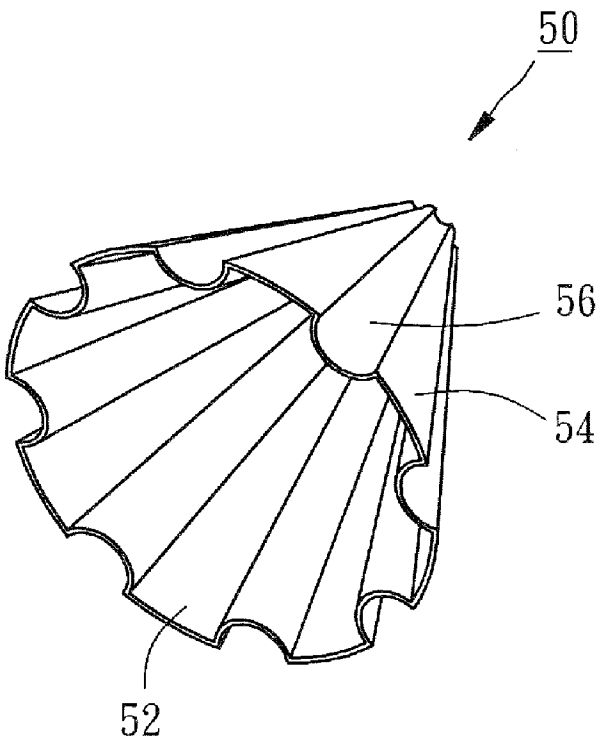
FIG. 7 is a perspective view of the powder-delivering device according to a forth embodiment of the present invention.

FIG.7 shows a powder-delivering device 50 in accordance with the fourth embodiment of the present invention. The linear projections 54 and the linear recesses 56 are integrally formed on the tapered shell 52 and arranged in a stagger manner.

Furthermore, the shape of the tapered shell of the powder-delivering device can be made with various kinds of design as long as the transection area of the tapered shell is becoming smaller toward the outlet of the toner cartridge. In addition, the number, the shape and the extending distance of the projections are not limited as long as the tapered shell has at least one projection or/and at least one recess. Besides, the projections 24, 34, 44 and 54 and the recesses 26 and 56 can be regarded as the deformation of the outer surface of the tapered shell 20, 32, 42, and 52, i.e. the outer surface of the tapered shell is deformed at one place at least for achieving the objectives of the present invention The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A powder-delivering device for a toner cartridge having an outlet at one end thereof, said powder-delivering device comprising:

a tapered shell received in said toner cartridge near said outlet and having a transection area becoming smaller gradually toward said outlet, and an outer surface having at least one projection;

wherein said toner cartridge has a longitudinal direction and said projection of the tapered shell has a spiral shape and parallels said longitudinal direction.

2. The powder-delivering device as claimed in claim 1, wherein said projection has an end, which is remote from said outlet of said toner cartridge, stopped against an inner wall of said toner cartridge.

3. The powder-delivering device as claimed in claim 1, wherein said projection has an end, which is remote from said outlet of said toner cartridge and provided with a scraper stopped against an inner wall of said toner cartridge.

4. The powder-delivering device as claimed in claim 1, wherein said tapered shell comprises three said projections.

5. The powder-delivering device as claimed in claim 1, wherein said outer surface further comprises at least one recess, and the at least one projection is wider than the at least one recess.

* * * * *